US010856604B2

(12) United States Patent
Tanaka et al.

(10) Patent No.: US 10,856,604 B2
(45) Date of Patent: Dec. 8, 2020

(54) SHOE SOLE MEMBER AND SHOE

(71) Applicant: ASICS CORPORATION, Kobe (JP)

(72) Inventors: Yoshihito Tanaka, Kobe (JP); Shintaro Nagata, Kobe (JP); Takuro Kamimura, Kobe (JP); Hideyuki Miyazaki, Kobe (JP)

(73) Assignee: ASICS CORPORATION

( * ) Notice: Subject to any disclaimer, the term of this patent is extended or adjusted under 35 U.S.C. 154(b) by 0 days.

(21) Appl. No.: 15/760,585

(22) PCT Filed: Sep. 18, 2015

(86) PCT No.: PCT/JP2015/076637

§ 371 (c)(1),
(2) Date: Mar. 15, 2018

(87) PCT Pub. No.: WO2017/046936

PCT Pub. Date: Mar. 23, 2017

(65) Prior Publication Data

US 2018/0271210 A1 Sep. 27, 2018

(51) Int. Cl.
*A43B 13/14* (2006.01)
*A43B 17/00* (2006.01)
(Continued)

(52) U.S. Cl.
CPC ..... *A43B 13/04* (2013.01); *A43B 13/023* (2013.01); *A43B 13/12* (2013.01); *A43B 13/16* (2013.01);
(Continued)

(58) Field of Classification Search
CPC ..... A43B 13/04; A43B 13/32; A43B 13/16; A43B 13/023; A43B 13/187; A43B 13/12;
(Continued)

(56) References Cited

U.S. PATENT DOCUMENTS 3,643,353 A * 2/1972 Weight ..... A43B 9/12 36/44
4,034,137 A * 7/1977 Hofer ..... B32B 7/04 428/322.7
(Continued)

FOREIGN PATENT DOCUMENTS

JP 64-020804 A 1/1989
JP 03-11762 B2 2/1991
(Continued)

OTHER PUBLICATIONS

International Preliminary Report on Patentability for International Application No. PCT/JP2015/076637 with a completion date of Sep. 7, 2017.
(Continued)

*Primary Examiner* — Katharine Gracz
(74) *Attorney, Agent, or Firm* — Katten Muchin Rosenman LLP

(57) ABSTRACT

Provided is a shoe sole member including: a first foam member containing a first resin; and a second foam member containing a second resin, wherein the first foam member and the second foam member are fused, and the second resin has a melting point higher than that of the first resin by 20° C. or more.

13 Claims, 11 Drawing Sheets

(51) Int. Cl.

| | |
|---|---|
| ***A43B 13/04*** | (2006.01) |
| ***A43B 13/12*** | (2006.01) |
| ***A43B 13/32*** | (2006.01) |
| ***A43B 13/02*** | (2006.01) |
| ***A43B 17/14*** | (2006.01) |
| ***A43B 13/16*** | (2006.01) |
| ***A43B 13/18*** | (2006.01) |

(52) U.S. Cl.
CPC ..... *A43B 13/187* (2013.01); *A43B 13/32* (2013.01); *A43B 17/006* (2013.01); *A43B 17/14* (2013.01)

(58) Field of Classification Search
CPC ..... A43B 17/006; A43B 17/14; B32B 5/32; B32B 7/02; B32B 3/26; B32B 2250/22; B32B 15/08
See application file for complete search history.

(56) References Cited

U.S. PATENT DOCUMENTS 4,151,661 A * 5/1979 Namba ..... B29C 44/14 12/146 B
4,167,824 A * 9/1979 Wolpa ..... A43B 13/38 36/44
4,418,483 A * 12/1983 Fujita ..... A43B 13/12 36/28
4,581,187 A * 4/1986 Sullivan ..... B29D 35/122 249/112
4,595,551 A * 6/1986 Maurer ..... B29C 51/14 264/413
4,621,013 A * 11/1986 Holtrop ..... B32B 5/32 428/304.4
4,667,423 A * 5/1987 Autry ..... A43B 13/12 36/102
4,674,204 A * 6/1987 Sullivan ..... B29D 35/122 264/244
4,757,620 A * 7/1988 Tiitola ..... A43B 13/145 36/28
4,984,376 A * 1/1991 Walter ..... A43B 13/141 36/114
5,367,791 A 11/1994 Gross et al.
5,592,757 A * 1/1997 Jackinsky ..... A43B 13/12 36/114
6,038,790 A * 3/2000 Pyle ..... A43B 7/1425 36/28
6,061,928 A * 5/2000 Nichols ..... A43B 13/181 36/28
6,061,929 A * 5/2000 Ritter ..... A43B 3/0052 36/107
6,287,698 B1 * 9/2001 Zhu ..... A43B 13/32 428/424.4
6,346,210 B1 * 2/2002 Swartz ..... A43B 3/28 264/320
6,372,809 B1 * 4/2002 Asai ..... C08J 9/0052 521/139
8,881,428 B2 * 11/2014 Mackey ..... A43B 7/141 36/28
2002/0144363 A1 * 10/2002 Royall ..... A43B 3/128 12/142 N
2002/0144431 A1 * 10/2002 Knoerr ..... A43B 7/14 36/31
2003/0093920 A1 * 5/2003 Greene ..... A43B 7/141 36/25 R
2003/0172548 A1 * 9/2003 Fuerst ..... A43B 13/026 36/28
2004/0231915 A1 * 11/2004 Thompson, Jr. ..... B32B 5/02 181/290
2004/0258945 A1 * 12/2004 Kanayama ..... B32B 25/08 428/621
2005/0027025 A1 * 2/2005 Erb ..... A43B 7/28 521/50
2005/0060909 A1 3/2005 Kerns et al.
2007/0119075 A1 * 5/2007 Schindler ..... A43B 7/144 36/29
2007/0157405 A1 * 7/2007 Bogaerts ..... A47L 13/17 15/145
2007/0169379 A1 * 7/2007 Hazenberg ..... A43B 13/125 36/102
2007/0199210 A1 * 8/2007 Vattes ..... A43B 13/12 36/45
2007/0251572 A1 * 11/2007 Hoya ..... C08L 23/0815 136/256
2008/0081845 A1 * 4/2008 Yamada ..... A43B 13/04 521/134
2008/0229622 A1 * 9/2008 Mori ..... A43B 13/04 36/25 R
2009/0239965 A1 * 9/2009 Wada ..... A43B 13/04 521/150
2010/0154253 A1 * 6/2010 Imazato ..... A43B 13/04 36/114
2011/0159261 A1 * 6/2011 Sugimoto ..... B29C 44/1228 428/215
2011/0160324 A1 * 6/2011 Yamada ..... A43B 13/04 521/134
2012/0167416 A1 * 7/2012 Christensen ..... A43B 3/0057 36/103
2012/0204446 A1 8/2012 Tateishi et al.
2013/0036631 A1 * 2/2013 Nabernik ..... A43B 1/04 36/103
2013/0036633 A1 2/2013 Lee
2013/0102697 A1 * 4/2013 Shinchi ..... A43B 13/04 521/173
2013/0108827 A1 * 5/2013 Okada ..... B32B 7/12 428/121
2013/0247425 A1 * 9/2013 Davis ..... A43B 13/02 36/30 R
2014/0115925 A1 * 5/2014 Hurd ..... A43B 13/122 36/103
2014/0290097 A1 * 10/2014 Bann ..... A43B 13/127 36/102
2015/0143723 A1 * 5/2015 Tateishi ..... C08J 9/103 36/25 R
2015/0181975 A1 * 7/2015 Otsuka ..... A43B 13/04 36/28
2016/0023434 A1 * 1/2016 Scherzer ..... B32B 37/04 428/316.6
2016/0113353 A1 * 4/2016 Tateishi ..... A43B 13/04 36/28
2016/0113354 A1 * 4/2016 Tateishi ..... A43B 1/0045 521/139
2016/0157554 A1 * 6/2016 Adams ..... A43B 7/082 36/28
2017/0006962 A1 1/2017 Tanabe et al.
2017/0215522 A1 * 8/2017 Tateishi ..... A43B 13/04
2017/0267845 A1 * 9/2017 Baghdadi ..... C08L 53/025
2017/0318901 A1 * 11/2017 Nishi ..... A43B 13/22

FOREIGN PATENT DOCUMENTS

| | | | |
|---|---|---|---|
| JP | 04-089002 | A | 3/1992 |
| JP | 07-265108 | A | 10/1995 |
| JP | 2000-270901 | A | 3/2000 |
| JP | 2006-016518 | A | 1/2006 |
| JP | 2007-275275 | A | 10/2007 |
| WO | 2015/129555 | A1 | 3/2015 |

OTHER PUBLICATIONS

International Search Report for International Application No. PCT/JP2015/076637 dated May 19, 2015.
Extended European Search Report for European Patent Application No. 15 90 4123 dated Sep. 17, 2018.

* cited by examiner

SHOE SOLE MEMBER AND SHOE

FIELD

The present invention relates to a shoe sole member and a shoe, more specifically, to a shoe sole member used, for example, as an inner sole, a sock liner, a midsole, or an outsole, and a shoe provided with such shoe sole members.

BACKGROUND

Shoes used for various competitions are composed of various members. For example, a shoe sole is composed of shoe sole members such as an inner sole, a sock liner, a midsole, and an outsole. Most of the shoe sole members of this type are formed by resin foams. Conventionally, one shoe sole member is formed by a plurality of members having different colors or properties, for example, in order to impart design properties to a shoe or exert partially different properties. For example, Patent Literature 1 below discloses producing a shoe sole member by crosslinking and foaming the insole and the outsole within a forming mold so as to be integrated. Further, Patent Literature 2 discloses producing a shoe sole member by arranging an inner layer foam within a forming mold, injecting a liquid polyurethane material into the forming mold, and foaming the polyurethane material.

CITATION LIST

Patent Literature

Patent Literature 1: JP 2000-270901 A
Patent Literature 2: JP H3-11762 B

SUMMARY

Technical Problem

Generally, it is difficult to bond members composed of resin foams to each other with high adhesion, as compared with non-foam members. The methods for thermally fusing foam members to each other within a mold, as disclosed in the aforementioned patent literatures, enable not only convenient production of shoe sole members but also integration of the foam members with excellent adhesion. Further, a shoe sole member formed by thermally fusing a plurality of foam members can exert excellent adhesion due to chemical bonding between the foam members by causing a crosslinking reaction in each foam member in the thermal fusion. However, when the plurality of foam members are sufficiently thermally fused to each other and each foam member is rendered in a sufficiently foamed state, each foam member deforms, and thus it is difficult to give an intended shape to the shoe sole member formed using the foam members. Therefore, the methods for producing a shoe sole member by thermally fusing a plurality of foam members have a problem that it is difficult to achieve stable appearance or properties of the shoe sole member to be produced, though it is comparatively easy to produce a shoe sole member in which foam members are firmly bonded to each other.

It is therefore an object of the present invention to provide a shoe sole member that can be easily produced with stable appearance and properties, and to provide a shoe of excellent quality.

Solution to Problem

In order to achieve the aforementioned objects, the present invention provides a shoe sole member including: a first foam member containing a first resin; and a second foam member containing a second resin, wherein the first foam member and the second foam member are thermally fused together, and the second resin has a melting point higher than that of the first resin by 20° C. or more.

In order to achieve the aforementioned objects, the present invention provides a shoe including the aforementioned shoe sole member.

DESCRIPTION OF EMBODIMENTS

Figure 1:
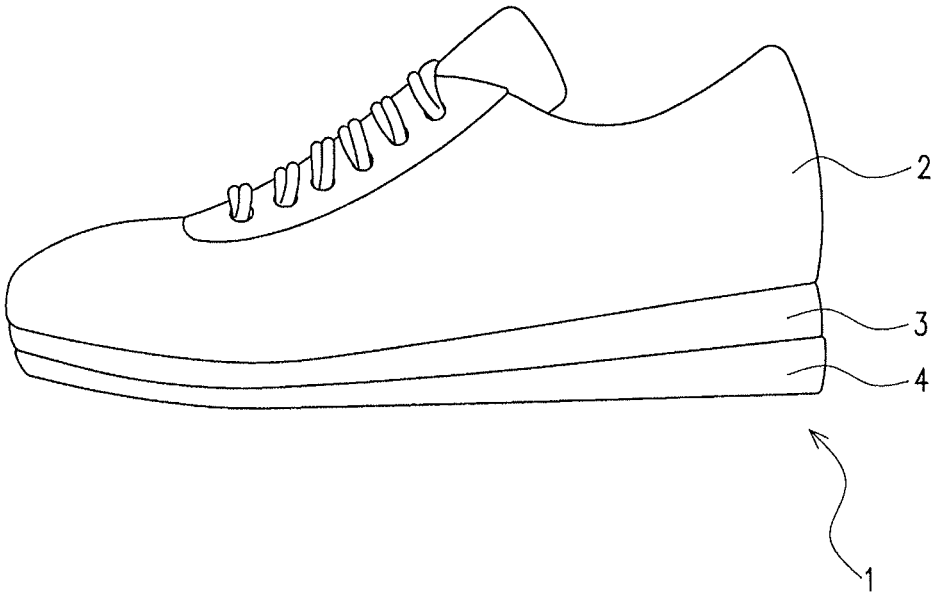
FIG. 1 is a schematic side view showing an embodiment of a shoe including a shoe sole member.

Hereinafter, a shoe sole member of the present invention will be described by way of embodiments thereof. FIG. 1 shows a shoe formed using shoe sole members of this embodiment. The shoe 1 has an upper material 2 and shoe sole members 3 and 4. The shoe 1 has a midsole 3 and an outsole 4 as the shoe sole members. Hereinafter, a midsole will be described as an example of the shoe sole member of the present invention.

As described later, the shoe sole member of this embodiment includes a first foam member containing a first resin and a second foam member containing a second resin, wherein the first foam member and the second foam member are thermally fused together, and the second resin has a melting point higher than that of the first resin by 20° C. or more. Therefore, the shoe sole member of this embodiment can be formed by thermally fusing the first foam member to the second foam member at a temperature equal to or lower than the melting point of the second foam member. Accordingly, when producing the shoe sole member of this embodiment by thermally fusing the first foam member and the second foam member together, a significant change in the shape of the second foam member between before and after the thermal fusion can be suppressed. The fact that it is easy to form the second foam member constituting the shoe sole member into a desired shape means that it is also easy to form the first foam member that constitutes the part other than the second foam member into a desired shape, in other words. Therefore, the shoe sole member of this embodiment, for example, enables each of the first foam member and the second foam member to have a sharp shape and enables, in the case where they have different colors, the boundary therebetween to be clear. In this embodiment, the first foam member and the second foam member are thermally fused together, and therefore the shoe sole member can be produced while omitting an adhesion step of bonding the first foam member and the second foam member together using an adhesive or the like. That is, the shoe sole member of this embodiment is also excellent in that the production process can be simplified.

It is preferable that, in the shoe sole member of this embodiment, the first foam member and the second foam member have different colors, and a first region formed by the first foam member and a second region formed by the second foam member be provided on an outer surface. A shoe sole member according to such a preferable embodiment exerts an effect of having excellent aesthetic appearance more significantly, while it is easy to produce the shoe sole member.

It is preferable that, in the shoe sole member of this embodiment, one or both of the first region and the second region be divided into a plurality of pieces so as to be discontinuous. According to such a preferable embodiment, the regions having different hues can be exposed on the surface in a discontinuous state, so that the shoe sole member can have more excellent aesthetic appearance. Further, the shoe sole member has a complex structure with a large number of boundaries between the first foam member and the second foam member, and therefore the effect of simplifying the production process is made more significant by their thermal fusion.

It is preferable that, in the shoe sole member of this embodiment, one of the first foam member and the second foam member have a recess or a through hole opening on the outer surface, and the other thereof be partially or entirely housed in the recess or the through hole. According to such a preferable embodiment, the outer surface of the shoe sole member can include islands having different colors in a region having a common hue, so that the shoe sole member can have more excellent aesthetic appearance. Further, the shoe sole member has a complex structure with a large number of boundaries between the first foam member and the second foam member, and therefore the effect of simplifying the production process is made more significant by their thermal fusion.

It is preferable that the shoe sole member of this embodiment have a plurality of such an opening as described above, and the openings be aligned from the heel side toward the toe side in a side part of a shoe. According to such a preferable embodiment, a pattern in which the plurality of islands are aligned can be formed, so that the shoe sole member can have more excellent aesthetic appearance. Further, the shoe sole member has a complex structure with a large number of boundaries between the first foam member and the second foam member, and therefore the effect of simplifying the production process is made more significant by their thermal fusion.

It is preferable that, in the shoe sole member of this embodiment, the openings be polygonal or circular. Further, it is preferable that, in the shoe sole member of this embodiment, the openings be rectangular, V-shaped, or X-shaped. According to such a preferable embodiment, the islands or the pattern can have further excellent aesthetic appearance. Further, the shoe sole member has a complex structure with a large number of boundaries between the first foam member and the second foam member, and therefore the effect of simplifying the production process is made more significant by their thermal fusion.

The shoe sole member of this embodiment makes it easy to give a change not only in hue but also in mechanical properties by site. For example, in the shoe sole member of this embodiment, the second foam member having different mechanical properties such as compression elastic modulus from those of the first foam member can be employed, so that the second foam member allows a specific site of the shoe sole member to express a different feeling from that in the first foam member. Further, in the shoe sole member of this embodiment, it is easy to produce the first foam member and the second foam member, while maintaining their specific shapes, as described above. Accordingly, the feeling exerted by the second foam member and the site where the feeling is exerted can be made stable, in mass production or the like of the shoe sole member of this embodiment.

Figure 2:
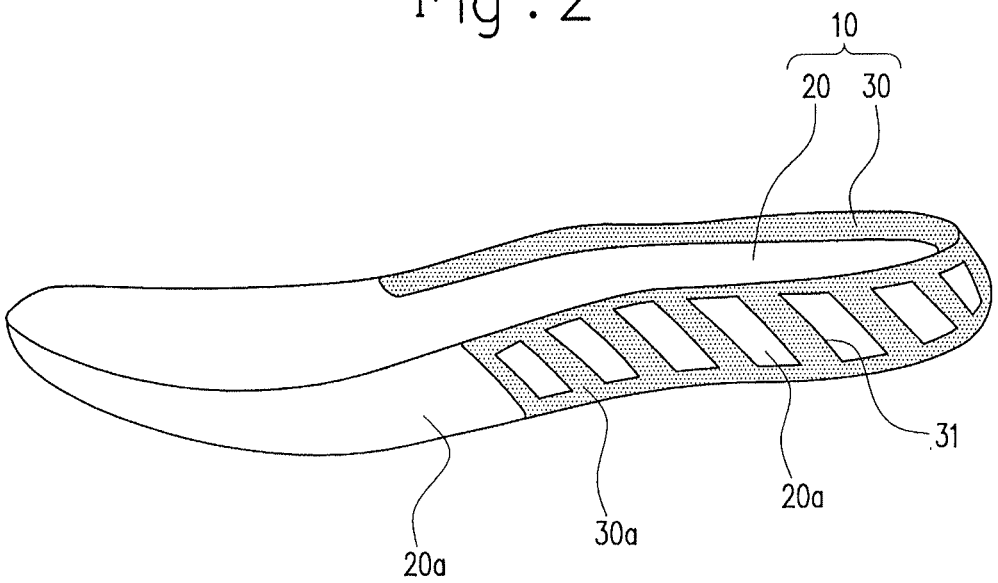
FIG. 2 is a perspective view of a shoe sole member according to an embodiment.

Hereinafter, the midsole 3 will be described in detail with reference to the drawings. FIG. 2 shows a shoe sole member 10 of this embodiment constituting the midsole 3 of the shoe 1. As shown also in this figure, the shoe sole member 10 of this embodiment is flat, and has the same planar contour as the shoe sole. The shoe sole member 10 of this embodiment constitutes the midsole 3 by being arranged on the shoe sole with its lateral sides exposed to the surface.

Figure 3:
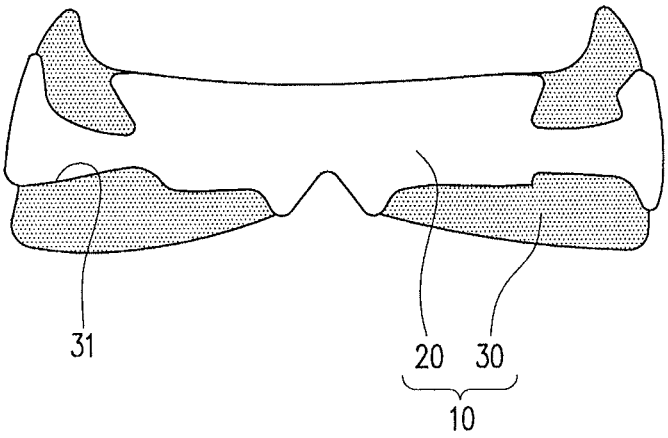
FIG. 3 is a sectional view of a shoe sole member according to an embodiment.

As shown in FIGS. 2 and 3, the shoe sole member 10 of this embodiment is formed by integrating two types of members and includes the first foam member 20 and the second foam member 30 as the members. The shoe sole member 10 of this embodiment may include a third member other than the first foam member 20 and the second foam member 30. In the shoe sole member 10 of this embodiment, both of the first foam member 20 and the second foam member 30 are exposed on at least the surfaces of the lateral sides among the outer surfaces. That is, the shoe sole member 10 of this embodiment includes a first region 20*a* formed by the first foam member 20 and a second region 30*a* formed by the second foam member 30 on its lateral sides.

Further, in the shoe sole member 10 of this embodiment, the first foam member 20 and the second foam member 30 have different colors, and a design is given to the lateral sides by the first region 20*a* and the second region 30*a* having different colors. Generally, colors are recognized as being different when the value of the color difference ($\Delta E^*ab$) defined in chapter 7.1.1 of JIS Z8730:2009 is 0.5 or more, and therefore the first foam member 20 and the second foam member 30 preferably have a color difference of 0.5 or more, more preferably 1.0 or more, for giving a brilliant design to the shoe sole member 10.

In the shoe sole member 10 of this embodiment, the first foam member 20 is exposed from the forefoot to the midfoot on the lateral sides, and the second foam member 30 is exposed from the hindfoot to the midfoot on the lateral sides. The lateral sides of the hindfoot of the shoe sole member 10 are formed by the second foam member 30, but the second foam member 30 exists only in the superficial portion, and the inside thereof is formed by the first foam member 20. That is, the second foam member 30 forms only the site in the vicinity of the lateral sides of the shoe sole member 10 and thus has a U-shape surrounding the heel of the foot in plan view.

As shown in FIG. 3, in the shoe sole member 10 of this embodiment, the second foam member 30 has a through hole 31 opening on the outer surface, and the inside of the through hole is filled with a part of the first foam member 20. Further, the second foam member 30 has a plurality of through holes 31, and the openings of the through holes 31 are aligned from the heel side toward the toe side in side parts of the shoe. That is, the first foam member 20 has a plurality of projections that correspond to the plurality of through holes 31 of the second foam member 30 and has a plurality of projections projecting outwardly from the inside of the hindfoot. Further, the first foam member 20 is integrated with the second foam member 30 by inserting the projections into the through holes 31. Thereby, in the shoe sole member 10 of this embodiment, the first region 20*a* is divided into a plurality of pieces so as to be discontinuous on the lateral sides of the hindfoot. As shown in FIG. 2, in the shoe sole member 10 of this embodiment, the first region 20*a* is divided into a plurality of rectangular regions.

The first region 20*a* and the second region 30*a* of this embodiment have different colors, as described above. Therefore, when the shoe sole member 10 is used as the midsole 3, the hue from the forefoot to the midfoot is different from the hue from the midfoot to the hindfoot, and a plurality of small rectangular patterns having the same color as that of the forefoot are aligned from the midfoot to the hindfoot, in the midsole 3. The shoe sole member 10 of this embodiment has excellent design properties due to the plurality of rectangular patterns having a different color from the peripheral color.

In conventional shoe sole members formed by thermally fusing a plurality of foam members, when excellent adhesion is exerted between the members, color flow may occur due to the shapes of the members not being sufficiently maintained in some cases. It is easy to produce the shoe sole member of this embodiment without color flow, since the first foam member 20 contains the first resin, the second foam member 30 contains the second resin, and the second resin has a melting point higher than that of the first resin by 20° C. or more. Moreover, the shoe sole member of this embodiment can exert excellent adhesiveness between the first foam member 20 and the second foam member 30 while preventing color flow. The first foam member 20 and the second foam member 30 are preferably crosslinked foams, in that excellent adhesiveness is easily exerted therebetween. That is, it is preferable that the first foam member 20 be composed of a polymer composition containing the first resin and a crosslinking agent (which is hereinafter referred to also as "first polymer composition"), and the second foam member 30 be composed of a polymer composition containing the second resin and a crosslinking agent (which is hereinafter referred to also as "second polymer composition").

The first resin and the second resin that serve as the main components of the first polymer composition and the second polymer composition are not specifically limited, and the same resins used for forming conventional shoe sole members can be employed.

Examples of the first resin or the second resin include olefin resins such as polyethylene (e.g., linear low density polyethylene (LLDPE) and high density polyethylene (HDPE)), polypropylene, ethylene-propylene copolymer, propylene-1-hexene copolymer, propylene-4-methyl-1-pentene copolymer, propylene-1-butene copolymer, ethylene-1-hexene copolymer, ethylene-4-methyl-pentene copolymer, ethylene-1-butene copolymer, 1-butene-1-hexene copolymer, 1-butene-4-methyl-pentene, ethylene-methacrylic acid copolymer, ethylene-methyl methacrylate copolymer, ethylene-ethyl methacrylate copolymer, ethylene-butyl methacrylate copolymer, ethylene-methyl acrylate copolymer, ethylene-ethyl acrylate copolymer, ethylene-butyl acrylate copolymer, propylene-methacrylic acid copolymer, propylene-methyl methacrylate copolymer, propylene-ethyl methacrylate copolymer, propylene-butyl methacrylate copolymer, propylene-methyl acrylate copolymer, propylene-ethyl acrylate copolymer, propylene-butyl acrylate copolymer, ethylene-vinyl acetate copolymer (EVA), and propylene-vinyl acetate copolymer.

Further, examples of the first resin or the second resin include polyamide resins such as polyamide 6, polyamide 11, polyamide 12, polyamide 66, and polyamide 610; and polyester resins such as polyethylene terephthalate and polybutylene terephthalate.

Further, various polymers other than the aforementioned polymers can be contained in the first polymer composition or the second polymer composition, and examples thereof include polyurethane polymers such as polyester polyurethanes and polyether polyurethanes; and styrene polymers such as styrene-ethylene-butylene copolymer (SEB), styrene-butadiene-styrene copolymer (SBS), a hydrogenated product of SBS (styrene-ethylene-butylene-styrene copolymer (SEBS)), styrene-isoprene-styrene copolymer (SIS), a hydrogenated product of SIS (styrene-ethylene-propylene-styrene copolymer (SEPS)), styrene-isobutylene-styrene copolymer (SIBS), styrene-butadiene-styrene-butadiene (SBSB), styrene-butadiene-styrene-butadiene-styrene (SBSBS), polystyrene, acrylonitrile styrene resin (AS resin), and acrylonitrile butadiene styrene resin (ABS resin).

Further, in the first polymer composition or the second polymer composition, fluorine-containing polymers such as fluororesin and fluororubber; polyvinyl chloride resins; acrylic resins such as polymethylmethacrylate; silicone elastomers; butadiene rubber (BR); isoprene rubber (IR); chloroprene (CR); natural rubber (NR); styrene butadiene rubber (SBR); acrylonitrile butadiene rubber (NBR); and butyl rubber (IIR), for example, can be also contained.

The first resin can be selected, for example, from resins having a melting point of 55° C. or more and less than 120° C., and the second resin can be selected, for example, from resins having a melting point of 75° C. or more and less than 150° C. The first resin is preferably selected from resins having a melting point of 60° C. or more and less than 100° C., and the second resin is preferably selected from resins having a melting point of 100° C. or more and less than 130° C. The difference in melting point between the first resin and the second resin is preferably 20° C. or more, and a combination with a larger difference in melting point is more preferable.

The melting point of the first resin and the second resin, for example, can be measured using a differential scanning calorimeter (DSC). More specifically, about 5 mg of a sample for measuring the melting point is prepared, the sample is set in the DSC together with substantially the same mass of a reference (for example, alumina powder) as the sample, and the melting point can be determined from a DSC curve obtained when the temperature of the sample is raised at a rate of temperature increase of 10° C./min under a stream of nitrogen gas. The melting point can be determined by performing differential scanning calorimetry analysis twice on the same sample, as a peak value in the DSC curve at the second time.

Further, the first resin and the second resin preferably exhibit comparatively similar molten states at a temperature equal to or more than their melting point, and preferably have close values of melt flow rate (MFR) or melt viscosity. The first resin and the second resin have MFR values, as determined at a temperature of 190° C. with a load of 2.16 kg, of 0.1 g/10 min or more and 20 g/10 min or less, preferably 0.1 g/10 min or more and 10 g/10 min or less, more preferably 0.1 g/10 min or more and 5 g/10 min or less. Further, a ratio (MFR2/MFR1) of the MFR (MFR2) of the second resin with respect to the MFR (MFR1) of the first resin is preferably 0.3 or more and 5.0 or less, more preferably 0.5 or more 3.0 or less, particularly preferably 0.5 or more 2.0 or less. Further, the first resin and the second resin preferably have a melt viscosity, as measured at a temperature of 140° C. and a shear speed of 50 $s^{-1}$ using a capillary rheometer, of 1000 Pa·s or more and 1700 Pa·s or less, more preferably 1200 Pa·s or more and 1500 Pa·s or less. The melt viscosity can be determined using a twin bore capillary rheometer (with a barrel diameter of 15 mm), with one equipped with a die (with a die diameter of 1 mm and a die length of 16 mm) and the other serving as a 1-mm diameter orifice.

Olefin-based polymers are preferable as the main component of the first polymer composition or the second polymer composition in that they can allow the shoe sole member 10 to exert excellent cushioning properties, excellent chemical resistance, and hydrolysis resistance. Among these, it is preferable that the first resin and the second resin be copolymers of ethylene with α-olefins such as 1-butene and 1-hexene (ethylene-α-olefin copolymers) or ethylene-vinyl acetate copolymers, for ease of crosslinking. Further, in the case where the first resin and the second resin are ethylene-vinyl acetate copolymers, the ethylene-vinyl acetate copolymers preferably have a content of vinyl acetate of 15 mass % or more and 25 mass % or less.

As the crosslinking agent for crosslinking these resins, organic peroxides, maleimide crosslinking agents, sulfur, phenolic crosslinking agents, oximes, and polyamines, for example, can be employed. Among these, organic peroxides are preferable. Further, it is also possible to form a crosslinked structure using electron beam.

As the organic peroxides, one or two or more selected from dicumyl peroxide, di-t-butyl peroxide, 2,5-dimethyl-2,5-di-(t-butylperoxy)hexane, 2,5-dimethyl-2,5-di-(t-butylperoxy)hexyne-3,1,3-bis(t-butylperoxyisopropyl)benzene, 1,1-bis(t-butylperoxy)-3,3,5-trimethylcyclohexane, n-butyl-4,4-bis(t-butylperoxy)valerate, benzoyl peroxide, p-chlorobenzoyl peroxide, 2,4-dichlorobenzoyl peroxide, t-butylperoxybenzoate, t-butyl perbenzoate, t-butylperoxyisopropyl carbonate, diacetyl peroxide, lauroyl peroxide, and t-butyl cumyl peroxide, for example, can be employed.

The organic peroxides are used, for example, at a ratio of 0.01 part by mass or more and 10 parts by mass or less with respect to 100 parts by mass of the polymers contained in the first polymer composition or the second polymer composition in total.

Further, examples of the crosslinking aid contained in the first polymer composition or the second polymer composition together with the crosslinking agent include divinyl benzene, trimethylolpropanetrimethacrylate, 1,6-hexanediol methacrylate, 1,9-nonanediol dimethacrylate, 1,10-decanediol dimethacrylate, trimellitic acid triallyl ester, triallyl isocyanate, neopentyl glycol dimethacrylate, 1,2,4-benzene tricarboxylic acid triallyl ester, tricyclodecane dimethacrylate, and polyethylene glycol diacrylate.

Further, in this embodiment, inorganic particles having high surface energy such as clay, talc, silica, and carbon black may be contained in the first polymer composition or the second polymer composition.

The foaming agent for rendering the first foam member or the second foam member into a good foamed state is not specifically limited, and examples thereof include organic or inorganic chemical foaming agents and physical foaming agents. As the foaming agent, one or two or more selected from azo compounds such as azodicarbonamide (ADCA), 1,1'-azobis(1-acetoxy-1-phenylethane), dimethyl-2,2'-azobisbutyrate, dimethyl-2,2'-azobisisobutyrate, 2,2'-azobis(2,4,4-trimethylpentane), 1,1'-azobis(cyclohexane-1-carbonitrile), and 2,2'-azobis[N-(2-carboxyethyl)-2-methylpropionamidine]; nitroso compounds such as N,N'-dinitrosopentamethylenetetramine (DPT); hydrazine derivatives such as 4,4'-oxybis(benzenesulfonyl hydrazide) and diphenylsulfone-3,3'-disulfonyl hydrazide; semicarbazide compounds such as p-toluenesulfonyl semicarbazide; and thermally decomposable organic foaming agents such as trihydrazino triazine, for example, can be employed.

Further, as the foaming agent, one or two or more selected from bicarbonates such as sodium hydrogencarbonate and ammonium hydrogen carbonate; carbonates such as sodium carbonates and ammonium carbonates; nitrites such as ammonium nitrite; and thermally decomposable inorganic foaming agents such as hydrogen compounds can be employed.

Further, organic foaming agents including various aliphatic hydrocarbons such as methanol, ethanol, propane, butane, pentane, and hexane, and inorganic foaming agents such as air, carbon dioxide, nitrogen, argon, and water also can be used as the foaming agent for forming the crosslinked foam.

Examples of other additives to be contained in the first polymer composition or the second polymer composition include a dispersant, a processing aid, a weathering agent, a flame retardant, a pigment, a mold release agent, an antistatic agent, an antibacterial agent, and a deodorizer. The first polymer composition and the second polymer composition can generally contain the first resin and the second resin, respectively, at a ratio of 50 mass % or more, preferably 75 mass % or more. The content of various additives in the first polymer composition or the second polymer composition is generally 25 mass % or less, preferably 10 mass % or less.

Next, a method for producing a shoe sole member according to this embodiment will be described. The shoe sole member according to this embodiment can be produced, for example, by performing the following steps (a) to (c).

(a) Step of Producing Foamable Member

As foamable members that can be foamed by heating, two types of foamable members, which are a foamable member that serves as the first foam member (which is hereinafter referred to also as "first foamable member") and a foamable member that serves as the second foam member (which is hereinafter referred to also as "second foamable member"), are produced. Then, a preform that serves as the shoe sole member 10 by being foamed is produced using these foamable members. The first foamable member is produced using the first polymer composition containing the first resin, the foaming agent, the crosslinking agent, and the like. The second foamable member is produced using the second polymer composition containing the second resin, the foaming agent, the crosslinking agent, and the like. In this embodiment, the preform is produced using the first foamable member and the second foamable member. Further, in this embodiment, only the first foamable member can be rendered into a thermally deformable state in the same forming mold in which the second foamable member is put due to the first foamable member containing a resin with a lower melting point than in the second foamable member. Therefore, the preform can be produced using the second foamable member and the first foamable member that is irregularly shaped by forming only the second foamable member into a specific shape in advance. For example, in the case of producing the shoe sole member as shown in FIGS. 2 and 3, the preform can be produced with excellent profile accuracy, even if the first foamable member is irregularly shaped, by molding the second polymer composition first using the forming mold to produce a U-shaped molded product and providing a through hole through the molded product, as needed, to produce the second foamable member.

(b) Step of Producing Preform (Low Temperature Molding Step)

The preform can be produced by molding the first foamable member and the second foamable member using the forming mold. The preform can be produced, for example, by putting the irregularly shaped first foamable member into the forming mold in which the U-shaped second foamable member is put at a predetermined position and performing molding under temperature conditions in which the first foamable member is plastically deformed and the second foamable member exerts an elastic recovering force against the deformation. At this time, the difference in melting point between the first resin that is the main component of the first foamable member and the second resin that is the main component of the second foamable member is 20° C. or more, thereby allowing each of the first foamable member and the second foamable member to have excellent shape accuracy, in the preform to be obtained.

(c) Step of Producing Shoe Sole Member (Heating and Foaming Step)

The thus produced preform can be a foam molded article corresponding to the shape of the shoe sole member by being foamed by heating in the forming mold having a cavity corresponding to the shape of the shoe sole member. The shoe sole member of this embodiment can be produced, for example, by performing a finishing step such as removing burrs in the foam molded article. In this embodiment, the shoe sole member with excellent lightweight properties and excellent design properties can be formed using the preform. Further, in the shoe sole member of this embodiment, the first foam member 20 and the second foam member 30 are crosslinked foams, and therefore the following effects are exerted in this step. First, when the preform is heated to foam the preform, the first foamable member containing the resin that has a lower melting point is softened earlier than the second foamable member, to start the crosslinking reaction. Thereafter, when the temperature of the preform has reached the temperature at which the second foamable member is softened, the first foamable member is crosslinked to some extent, and therefore the first foamable member does not exhibit excessive fluidity, so that the occurrence of color flow in the shoe sole member can be prevented. Then, the first resin and the second resin can be crosslinked at the interface between the first foam member and the second foam member, so that chemical adhesion due to the crosslinking reaction can be exerted at the interface. Further, in this step, the first foamable member and the second foamable member are foamed by the foaming agents, and volume expansion of both of the first foamable member and the second foamable member acts on the interface as high pressure, as a result of which the shoe sole member in which the first foam member and the second foam member are firmly thermally fused can be obtained.

A detailed description for this point will be given below. Generally, the surface of the foam molded article formed by the molding surface of the forming mold serves as the outer surface of the shoe sole member. Here, in the heating and foaming step, the raw material of the foam molded article tends to flow along the molding surface of the forming mold. Therefore, in conventional production methods, if the preform is formed using two members made of different materials, and one and the other of these members are arranged adjacent to each other with a boundary formed on the surface of the preform, the one member may flow over the boundary to partially cover the surface of the other member in the produced foam molded article, in some cases. That is, in the conventional production methods, even if the rectangular patterns as shown in FIG. 2 are tried to be exposed on the surface of the shoe sole member using the other member, the contour shapes of the patterns tend to deform. Further, in the conventional production methods, the other member may be embedded by the one member so as to fail to appear on the surface of the shoe sole member to be formed, in some cases. In order to deal with such a problem, it is conceivable to form the preform while predicting the flow of the materials in the heating and foaming step, in the conventional production methods. Specifically, in the case where the rectangular patterns are formed by the other member in the shoe sole member, it is conceivable to form the rectangular patterns having a desired size as a result of producing the preform so that patterns one size larger than the rectangular patterns that are originally formed in the shoe sole member are formed and allowing the one member to flow over the boundary on the surface of the foam molded article so as to enter the other member side in the heating and foaming step. In this case, the position of the boundary between the one member and the other member inside the foam molded article does not coincide with the boundary therebetween on the surface of the foam molded article, but desired patterns are formed on the surface. However, it is difficult to accurately grasp the degree to which the one member flows to enter the other member side in advance. Moreover, in such a shoe sole member produced by the conventional production methods, the other member is thinly covered only by the one member in the gap of the actual boundary between the one member and the other member inside the shoe sole member from the apparent boundary therebetween on the surface. Accordingly, even if the degree to which the one member flows to enter the other member side could be predicted, the contour of the shape may be unclear in shoe sole member produced by the conventional production methods, for example, in the case where the hiding performance of the color tone of the one member is low. Meanwhile, the boundary between the first foam member 20 and the second foam member 30 formed on the surface of the shoe sole member in this embodiment coincides with the boundary between the first foam member 20 and the second foam member 30 inside the shoe sole member. That is, the boundary formed on the surface of the shoe sole member in this embodiment is located on the extension line obtained by extending the interface between the first foam member 20 and the second foam member 30 from the inside of the shoe sole member toward the surface of the shoe sole member. Therefore, the shoe sole member of this embodiment can allow clear patterns to be exposed on the surface, regardless of the color tones of the first foam member 20 and the second foam member 30.

Here, the case where both of the first foam member and the second foam member are crosslinked foams is described as an example, because the first foam member and the second foam member can have excellent shape accuracy, and excellent adhesiveness can be exerted between the first foam member and the second foam member, in such a case, but the first foam member and the second foam member are not necessarily crosslinked in the present invention, and one or both of them may be non-crosslinked foams.

Figure 4:
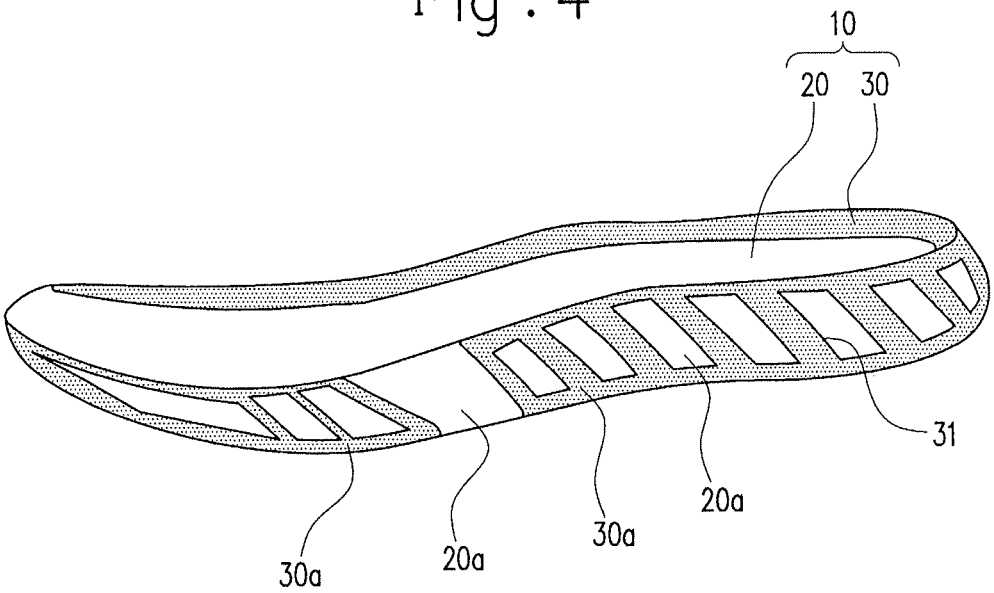
FIG. 4 is a perspective view of a shoe sole member according to another embodiment.
Figure 5:
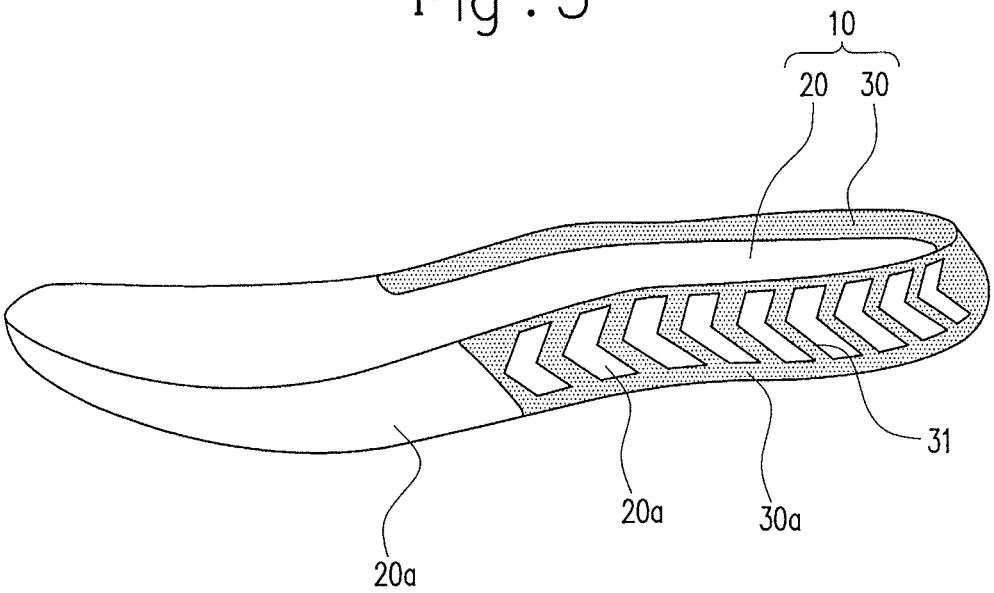
FIG. 5 is a perspective view of a shoe sole member according to another embodiment.
Figure 6:
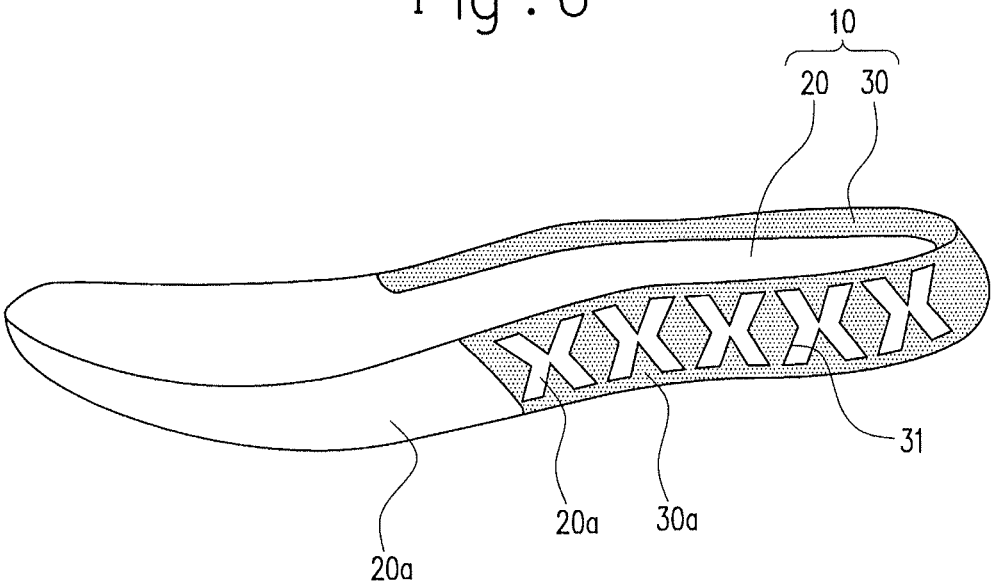
FIG. 6 is a perspective view of a shoe sole member according to another embodiment.

In this embodiment, the shoe sole member 10 in which rectangular patterns formed by the first region 20*a* being divided into a plurality of pieces are aligned in the side parts of the shoe, and the patterns are aligned from the heel side toward the toe side, so that excellent design properties can be given to the midsole 3, is described as an example, but the patterns may be V-shaped or X-shaped as shown in FIG. 5 and FIG. 6. Further, in this embodiment, the shoe sole member 10 in which the patterns are unevenly distributed on the heel side is described as an example, but the patterns may be entirely formed on the lateral side, as shown in FIG. 4. Further, the patterns may have a polygonal shape other than the rectangular shape, and may have a circular shape such as a perfect circle and an elongated circle.

In this embodiment, the first foam member 20 is partially housed in the through holes 31 provided through the second foam member 30, thereby forming the patterns on the lateral sides of the shoe sole member, but the patterns also can be formed by forming recesses in the second foam member instead of the through holes 31 and housing the first foam member in the recesses.

Figure 7:
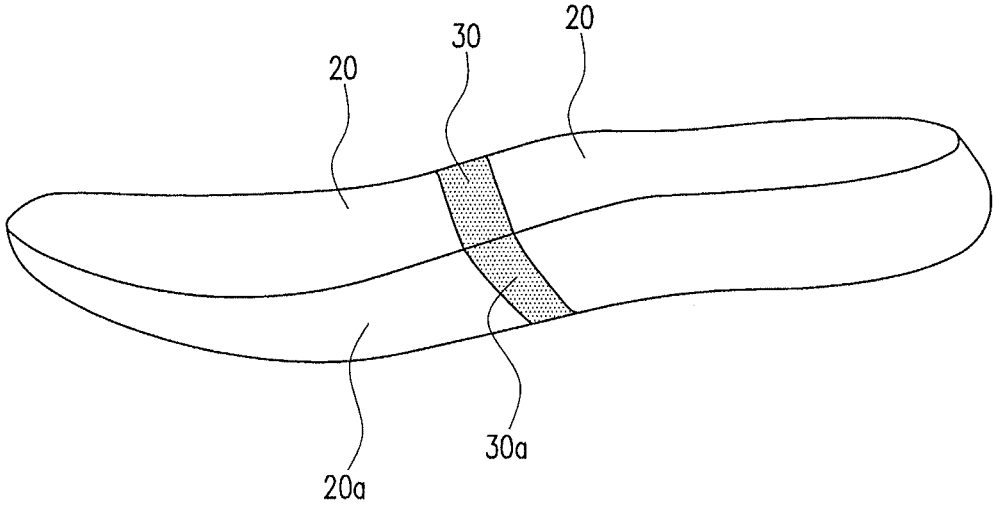
FIG. 7 is a perspective view of a shoe sole member according to another embodiment.
Figure 8:
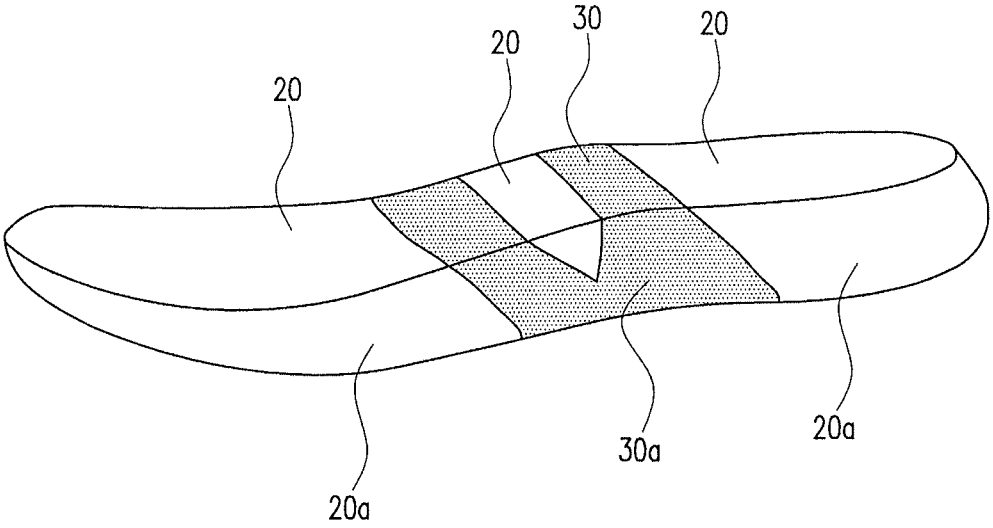
FIG. 8 is a perspective view of a shoe sole member according to another embodiment.

As shown in FIG. 7, the shoe sole member 10 of this embodiment may be formed by arranging the second foam member 30 between the front and rear pieces of the first foam member 20 divided in the longitudinal direction of the shoe. That is, the shoe sole member 10 of this embodiment may be configured so that the second foam member 30 is sandwiched by two divided pieces of the first foam member 20 from the front and rear sides in the longitudinal direction of the shoe. Further, as shown in FIG. 7, the shoe sole member 10 of this embodiment may be configured so that one of the first region and the second region forms a line pattern on the lateral sides of the shoe sole member. In the conventional methods, it is difficult to form clean lines since the lines are easily distorted. That is, in the embodiment in which the line pattern is formed, the effects of the present invention can be exerted more significantly. Further, in the shoe sole member 10 of this embodiment, the one region may form the line pattern on at least one of the upper surface and the lower surface of the shoe sole member. The line pattern may be a stripe pattern in which a plurality of lines are formed parallel to each other. Further, in the shoe sole member 10 of this embodiment, the one region may form line patterns extending in the thickness direction of the shoe sole member on the lateral sides of the shoe sole member. The line patterns formed on the lateral sides of the shoe sole member may be inclined toward the heel side in a direction from above to below. Further, as shown in FIGS. 7 and 8, the shoe sole member 10 of this embodiment may be configured so that one of the first foam member 20 and the second foam member 30 has a rod shape, and such a member is arranged to extend in the width direction of the shoe. The shoe sole member can have excellent bending properties by allowing the member extending in the width direction of the shoe sole member to have lower elasticity (which is easily distorted) than the other member. The member is not necessarily exposed on the surfaces on the lateral sides of the shoe and may be embedded in the other member. Further, in the shoe sole member 10 of this embodiment, the member may be arranged to cross the center in the longitudinal direction of the shoe. The shoe generally bends at a position of the arch closer to the toe when a user walks. Therefore, as shown in FIG. 7, the shoe sole member 10 of this embodiment can give an image of having excellent bending properties on the appearance to the shoe by arranging different members adjacent to each other at the bending position during walking and can actually give excellent bending properties to the shoe by arranging the member having lower elasticity than in the other member at the bending position.

As shown in FIG. 8, the shoe sole member 10 of this embodiment may be configured so that the first foam member 20 is further interposed in the second foam member 30 that is sandwiched between the pieces of the first foam member 20. Further, as shown in FIG. 8, the shoe sole member 10 of this embodiment may be configured so that one of the first region and the second region has a shape tapered in one direction so as to have a sharp distal end. In the conventional methods, it is difficult to form a sharp shape (with an acute angle). That is, in the embodiment in which the distal end of the one of the first region and the second region is sharp, the effects of the present invention can be exerted more significantly. Further, the one region may be tapered in the thickness direction of the shoe sole member on the lateral sides of the shoe sole member.

Figure 9:
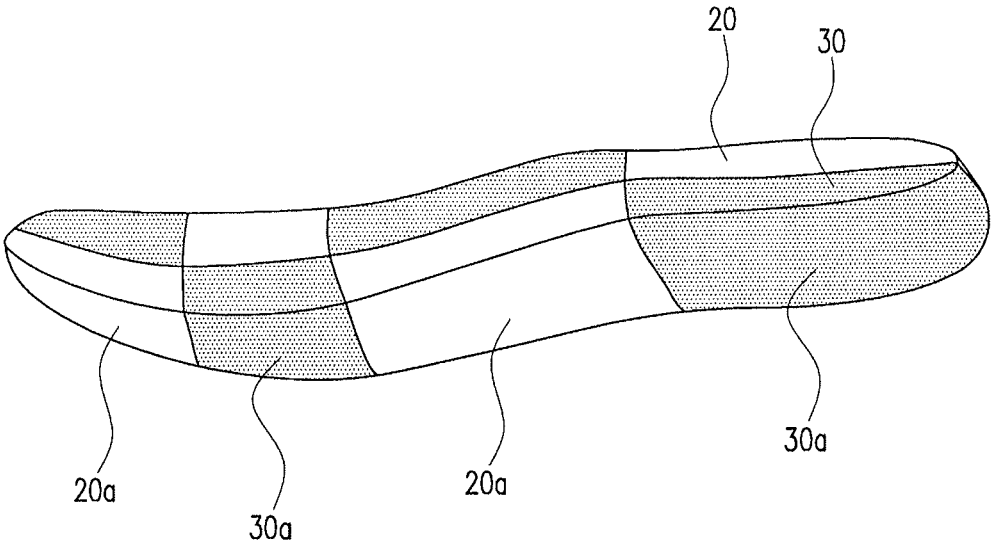
FIG. 9 is a perspective view of a shoe sole member according to another embodiment.

As shown in FIG. 9, in the shoe sole member 10 of this embodiment, the first foam member 20 and the second foam member 30 may be arranged so as to form a checkered pattern in plan view. Further, in the shoe sole member 10 of this embodiment, the first foam member and the second foam member may be arranged along the motion trajectory of the center of gravity during walking or running. The aforementioned arrangement can allow smooth motion of the center of gravity.

Figure 10:
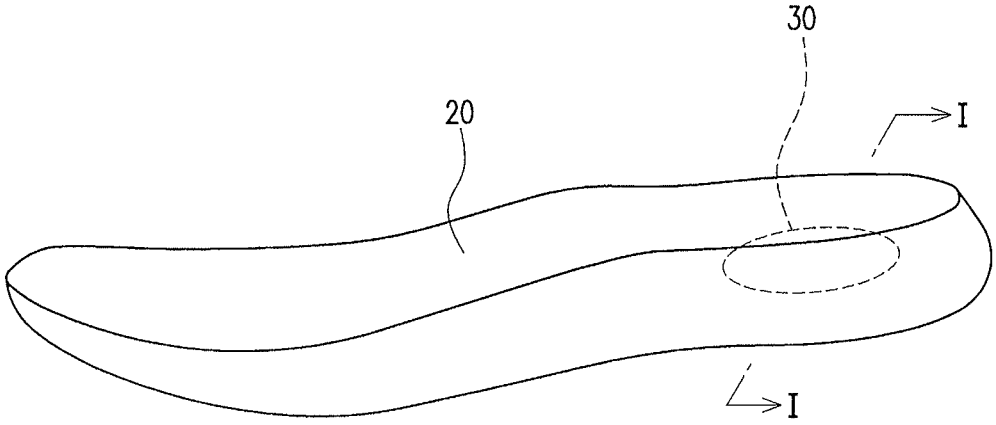
FIG. 10 is a perspective view of a shoe sole member according to another embodiment.
Figure 11:
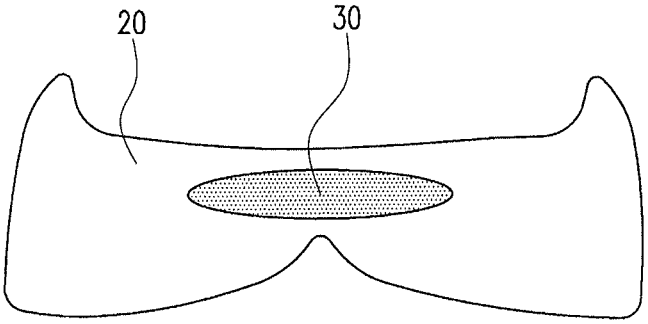
FIG. 11 is a cross-sectional view taken along the line I-I in FIG. 10, as viewed in the direction of the arrows.

In this embodiment, the shoe sole member in which the first region 20*a* formed by the first foam member 20 is divided into a plurality of pieces to be discontinuous on the outer surface is described as an example, but the second region may be divided into a plurality of pieces in the shoe sole member of this embodiment. Further, in the shoe sole member of this embodiment, the first region or the second region may be continuous without being divided. Further, the entire shoe sole member of this embodiment may be monochrome with one of the first foam member and the second foam member being embedded in the other thereof. That is, as shown in FIG. 10 and FIG. 11, the shoe sole member of the present invention may be configured, for example, so that the first foam member and the second foam member have different cushioning properties, the second foam member is embedded in the first foam member, and the shoe sole member exerts different cushioning properties in the sites where the second foam member is embedded, from those in the other sites, while having an appearance as if it were formed by one material. Also in this case, the effects are the same as those of the shoe sole members described as examples in FIG. 2 to FIG. 9, in that it is easy to give an intended shape to the second foam member, and excellent adhesiveness is exerted between the first foam member and the second foam member. In the case where the one foam member is embedded in the other foam member, these foam members do not need to have different colors.

In each of the shoe sole members shown in the aforementioned figures, the first foam member and the second foam member may be replaced with each other, and the shoe sole member of this embodiment may be configured by further using a third member having a different color or different mechanical properties from those of the first foam member or the second foam member, as described above. Further, a portion bonded by a method other than thermal fusion such as adhesion may be mixed at the boundary between the first foam member and the second foam member.

Further, in this embodiment, the midsole is described as an example of the shoe sole member, but the present invention exerts excellent effects as described above by way of the example of the midsole, also in the case where the shoe sole member is an outsole or the like. Further, the shoe sole member and the shoe according to the present invention are not limited to the aforementioned embodiments at all. That is, various modifications can be made to the shoe sole member and the shoe according to the present invention without departing from the gist of the present invention.

EXAMPLES

Next, the present invention will be described further in detail by way of Experimental Examples. However, the present invention is not limited to these examples.

Experimental Examples 1-13

A first foamable member containing a first resin shown in Table 1 and a foaming agent and a second foamable member containing a second resin shown in Table 1 and a foaming agent were arranged in a forming mold, followed by heating at 120° C. for 3 minutes to obtain a preform formed by the first foamable member and the second foamable member. Subsequently, the preform was heated in the forming mold at 160° C. for 20 minutes, so that the first foamable member and the second foamable member were foamed and thermally fused, so as to obtain shoe sole members of Experimental Examples. As the first resin, ethylene-vinyl acetate copolymer (EVA) or ethylene-α-olefin copolymer (olefin) was employed. As the second resin, ethylene-vinyl acetate copolymer (EVA) or ethylene-α-olefin copolymer (olefin) was employed. Further, ADCA was used as each foaming agent. Further, dicumyl peroxide (DCP) was used as a crosslinking agent. The melting point and the shear viscosity (at a temperature of 140° C. and a shear speed of 50 (1/s)) of the first resin and the second resin were measured by the aforementioned methods. The presence or absence of color flow in the shoe sole members of Experimental Examples was observed by visual inspection and evaluated based on the following criteria.

A: No color flow was observed
B: Almost no color flow was observed
C: Color flow was observed

TABLE 1

| Experimental Example | | Type of resin | Melting point (° C.) | Difference in melting point*1 (° C.) | Melt viscosity (Pa · s) | Melt viscosity ratio*2 | Evaluation results for color flow |
|---|---|---|---|---|---|---|---|
| #1 | First resin | Olefin | 65 | 58 | 1433 | 1.0 | A |
| | Second resin | Olefin | 122 | | 1395 | | |
| #2 | First resin | Olefin | 65 | 57 | 1371 | 1.0 | A |
| | Second resin | Olefin | 122 | | 1395 | | |
| #3 | First resin | Olefin | 66 | 56 | 967 | 0.7 | B |
| | Second resin | Olefin | 122 | | 1395 | | |
| #4 | First resin | Olefin/EVA | 90 | 32 | 1370 | 1.0 | A |
| | Second resin | Olefin | 122 | | 1395 | | |
| #5 | First resin | Olefin | 94 | 28 | 1240 | 0.9 | B |
| | Second resin | Olefin | 122 | | 1395 | | |
| #6 | First resin | Olefin | 97 | 25 | 1307 | 0.9 | B |
| | Second resin | Olefin | 122 | | 1395 | | |
| #7 | First resin | Olefin | 112 | 10 | 1403 | 1.0 | C |
| | Second resin | Olefin | 122 | | 1395 | | |
| #8 | First resin | Olefin | 122 | 0 | 1463 | 1.0 | C |
| | Second resin | Olefin | 122 | | 1395 | | |
| #9 | First resin | Olefin | 124 | 2 | 818 | 0.6 | C |
| | Second resin | Olefin | 122 | | 1395 | | |
| #10 | First resin | Olefin | 129 | 6 | 1389 | 1.0 | C |
| | Second resin | Olefin | 122 | | 1395 | | |
| #11 | First resin | Olefin | 66 | 22 | 1762 | 1.7 | B |
| | Second resin | EVA | 88 | | 1024 | | |
| #12 | First resin | EVA | 84 | 4 | 1066 | 1.0 | C |
| | Second resin | EVA | 88 | | 1024 | | |
| #13 | First resin | EVA | 81 | 7 | 555 | 0.5 | C |
| | Second resin | EVA | 88 | | 1024 | | |

*1"Difference in melting point" means the difference between the melting point of the first resin and the melting point of the second resin.
*2"Melt viscosity ratio" means a ratio ($\eta 1/\eta 2$) of the melt viscosity of the first resin ($\eta 1$) with respect to the melt viscosity of the second resin ($\eta 2$).

It can be seen also from the aforementioned results that the present invention provides a shoe sole member in which color flow is less likely to occur and which is easily produced with stable quality.

REFERENCE SIGNS LIST

1: Shoe
3: Midsole
4: Outer sole
10: Shoe sole member
20: First foam member
20*a*: First region
30: Second foam member
30*a*: Second region
31: Through hole

The invention claimed is:

1. A shoe sole member comprising:
a first foam member containing a first resin; and
a second foam member containing a second resin, the first and second resins being different materials, wherein
the first foam member and the second foam member are thermally fused together,
the second resin has a melting point higher than that of the first resin by 32° C. or more,
the first resin has a melting point of 60° C. or more and less than 100° C., and
the second resin has a melting point of 100° C. or more and less than 130° C.

2. The shoe sole member according to claim 1, wherein
the first foam member and the second foam member have different colors, and
a first region formed by the first foam member and a second region formed by the second foam member are provided in an outer surface.

3. The shoe sole member according to claim 2, wherein
one or both of the first region and the second region are divided into a plurality of pieces so as to be discontinuous.

4. The shoe sole member according to claim 1, wherein
one of the first foam member and the second foam member has a recess or a through hole opening on the outer surface, and
the other thereof is partially or entirely housed in the recess or the through hole.

5. The shoe sole member according to claim 4, further comprising:
a plurality of openings as set forth, wherein
the openings are aligned in a side part of a shoe from the heel side toward the toe side.

6. The shoe sole member according to claim 4, wherein the openings are polygonal or circular.

7. The shoe sole member according to claim 6, wherein the openings are rectangular, V-shaped, or X-shaped.

8. A shoe comprising:
the shoe sole member according to claim 1.

9. A method of producing a shoe sole member comprising a first foam member containing a first resin and a second foam member containing a second resin, the first and second resins being different materials, the first foam member and the second foam member-being thermally fused together, the method comprising:
a step of producing a preform with a first foamable member that is foamed to serve as the first foamable member and a second foamable member that is foamed to serve as the second foamable member; and
a step of producing a shoe sole member by heating the preform housed in a forming mold having a cavity corresponding to a shape of the shoe sole member to foam both of the first foamable member and the second foamable member to allow volume expansion of the first foamable member and the second foamable member in the forming mold, wherein,
in the step of producing the preform, the first foamable member and the second foamable member are used, in which the second resin has a melting point higher than that of the first resin by 32° C. or more, the first resin has a melting point of 60° C. or more and less than 100° C., and the second resin has a melting point of 100° C. or more and less than 130° C.

10. The method according to claim 9, wherein, in the step of producing the preform, a molded product formed of the second foamable member and the first foamable member in an irregular shape are put into the forming mold for producing the preform so that the first formable member is plastically deformed in the forming mold to produce the preform.

11. The shoe sole member according to claim 1, wherein a ratio of melt flow rate (MFR) of the second resin to MFR of the first resin is 0.5 or more and 2.0 or less.

12. The shoe sole member according to claim 1, wherein the first resin and the second resin have MFR value of 0.1 g/10 min or more and 5 g/10 min or less, as determined at a temperature of 190° C. with a load of 2.16 kg.

13. The shoe sole member according to claim 1, wherein the first resin and the second resin have a melt viscosity of 1200 Pa·s or more and 1500 Pa·s or less, as measured at a temperature of 140° C. and a shear speed of 50 $s^{-1}$ using a capillary rheometer.

* * * * *